United States Patent [19]

Wiggins

[11] Patent Number: 4,858,246

[45] Date of Patent: Aug. 22, 1989

[54] GOLF GLOVES FOR IMPROVED GRIPPING

[76] Inventor: Charles W. Wiggins, 5008 N. Lake Hill Rd., Delaware, Ohio 43015

[21] Appl. No.: 55,470

[22] Filed: May 29, 1987

[51] Int. Cl.[4] ..... A41D 19/00

[52] U.S. Cl. ..... 2/161 A; 2/163; 2/162

[58] Field of Search ..... 2/161 A, 163, 162, 167, 2/159

[56] References Cited

U.S. PATENT DOCUMENTS

| | | | |
|---|---|---|---|
| 2,379,430 | 7/1945 | Frost | 2/161 A |
| 3,224,012 | 12/1965 | Hamm | 2/161 A |
| 3,237,950 | 3/1966 | Harvey | 2/161 A |
| 3,249,359 | 5/1966 | Goldberger | 2/159 X |
| 3,255,462 | 6/1966 | Antonious | 2/161 A |
| 3,390,271 | 1/1976 | Kahng | 2/161 A |
| 4,057,255 | 11/1977 | Bishop | 2/161 A |
| 4,643,428 | 2/1978 | Churchill | 2/161 A |

*Primary Examiner*—Ronald Feldbaum

[57] ABSTRACT

An improved golf glove used as a training aid having an adjustable strap that forms a loop for the thumb attached to back of the glove extending approximately forty-five degrees from a line taken through the middle finger of the glove, a second strap attached to the index and middle finger of the glove approximately midway between the tip of the finger and the base of the finger stalls forming a loop between the back of the inner portions of the index and middle fingers of the glove.

6 Claims, 3 Drawing Sheets

GOLF GLOVES FOR IMPROVED GRIPPING

BACKGROUND INVENTION

1. Field Of The Invention

This invention relates to Golf Gloves, especially for use in practice to facilitate an improved feel, grip and swing of the golf club.

2. Description Of Prior Art

Most golfers wear golf gloves not only for protection of the hand, but also to improve their ability to grip the handle of the golf club.

A variety of gloves have been developed to aid golfers in gripping the golf club.

One such golf glove consisted of a flexible fabric covering the palm side of the hand. The fabric, having an inner surface facing the hand and an outer surface with tack-like members extending outward. This glove afforded users better gripping of the golf club handle by way of tack-like members digging into the handle of the golf club. This glove, however, affords only improved gripping with the gloved hand.

Another type of glove comprised a series of pads on the palmar surface of the first, second and third fingers as well as the palm of the glove. This glove is said to improve the golfers swing by enhancing the feel of the golf club in the golfer's hand. Again, however, this glove only improves the portion of the grip affected by the gloved accuracy hand.

Most golfers would find it desirable to have a golf glove which could improve the grip by making both hands work as one unit.

OBJECTS AND ADVANTAGES

Accordingly, I claim the following are objects and advantages of the invention: to provide a golf glove that improves the grip of the accuracy hand and binds the opposing power hand to the gloved accuracy hand to make the hands work as one unit when gripping the handle of the golf club.

In addition, I claim the following additional objects and advantages: to provide a golf glove that can be used with minimal training in the use thereof, which allows for a more positive feel in gripping the handle of the golf club and more consistent swing.

Readers will find further objects and advantages of the invention from a consideration of the ensuing description and the accompanying drawings.

Figure 1:
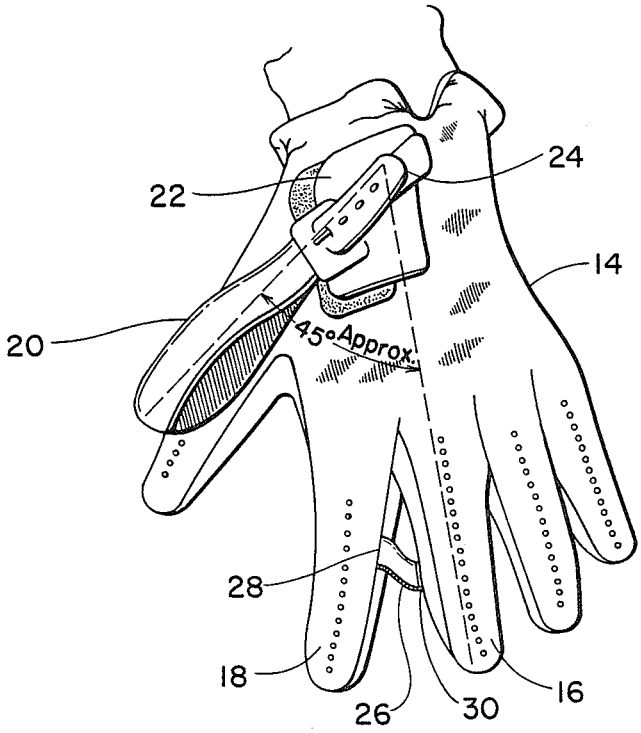
FIG. 1 shows a perspective dorsal elevational view of the golf glove according to the invention showing the interlocking grip variation of the fourth finger binding means.

DRAWING REFERENCE NUMERALS:

14-Glove

16- Second finger of glove

18- First finger of glove

20- Binding means for thumb of opposing hand

22- Wrist closure tab of glove

24- Adjustment means for thumb binding means

26-Binding means for fourth finger of opposing hand for use with the interlocking grip variation 26*a*-Binding means for fourth finger of opposing hand for use with the overlapping grip variation 28-Point of attachment to the first finger of the fourth finger binding means 30-Point of attachment to the second finger of the fourth finger binding means for use with the interlocking grip variation 32-Point of attachment to the second finger of the glove of the fourth finger binding means for use with the overlapping grip variation

GOLF GLOVE - - DESCRIPTION

FIG. 1 shows the golf glove according to a preferred embodiment of the invention. The glove comprises a glove 14, preferably made of leather. Attached to the glove 14 is a binding means for the thumb of opposing hand 20, this binding means being approximately two centimeters in width. The thumb binding means 20 forming a loop attached to the dorsal portion of the glove 14 at the wrist closure tab of glove 22. The attachment of the thumb binding means 20 being toward the thumb of the glove, at an angle of approximately forty-five degrees from a line bisecting the middle finger of the glove, as viewed from above in FIG. 1. The thumb binding means 20 having an adjustment means for thumb binding means 24 allowing for the enlargement or reduction in the size of the loop of the thumb binding means 20. The adjustment means 24 being made of either a metal buckle or nylon fastener.

And a second binding means being a binding means for fourth finger of opposing hand for use with the interlocking grip variation 26, which is approximately one centimeter in width. This binding means for the fourth finger 26 forming a loop approximately midway between the dorsal inner surface of the first finger of the glove 18 and the adjacent palmar surface of the second finger of the glove 16. This second binding means having the point of attachment 28 to the first finger of the glove 18 extending by way of the loop forming the fourth finger binding means 26 to the point of attachment to the second finger of the glove 30. This second binding means 26 being of substantially sufficient size to permit the fourth finger of the opposing hand to pass thru and be held snugly in place by this second binding means 26 while permitting varying positions of the fourth finger of the opposing power hand.

Figure 2:
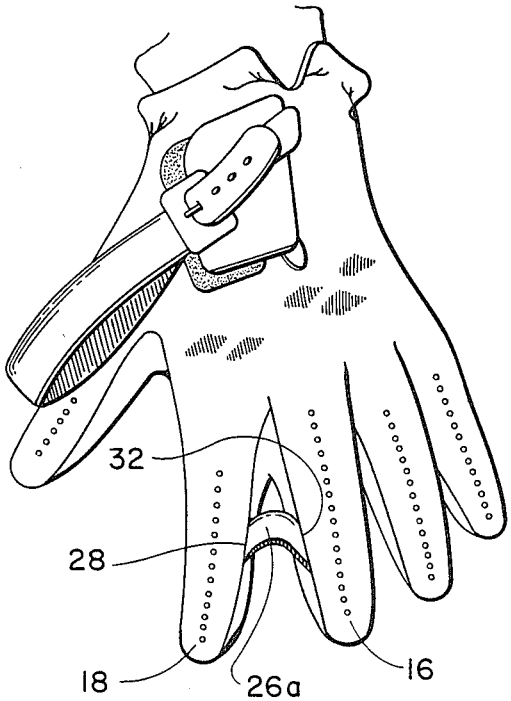
FIG. 2 shows a variation of the fourth finger binding means for use in the overlapping grip method.

FIG. 2 shows a variation of the glove as shown in FIG 1. The glove shown in FIG. 2 having the same features of the thumb binding means 20 as those described om reference to FIG. 1 above. However, FIG. 2 shows the binding means for fourth finger of opposing hand for use with the overlapping grip variation **26*a* which is also approximately one centimeter in width. This binding means for the fourth finger 26*a* forming a loop approximately midway between the dorsal inner surface of the first finger of the glove 18 and the adjacent dorsal inner surface of the second finger of the glove 16. This alternative second binding means 26*a* having the point of attachment 28 to the first of the glove 18 extending by way to the loop forming the fourth binding means 26***a* to the point of attachment 32 to the second finger of the glove 16. This alternative second binding means 26*a* being of substantially sufficient size to permit the fourth finger of the opposing power hand to pass thru and be held snugly in place by this second alternative binding means 26*a*, while permitting varying positions of the fourth finger of the opposing power hand.

GOLF GLOVE - - OPERATION

The golf gloves with binding means shown in FIG. 1 and FIG. 2 will enable the user to bind the gloved accuracy hand to the opposing power hand to work as one unit.

Figure 3:
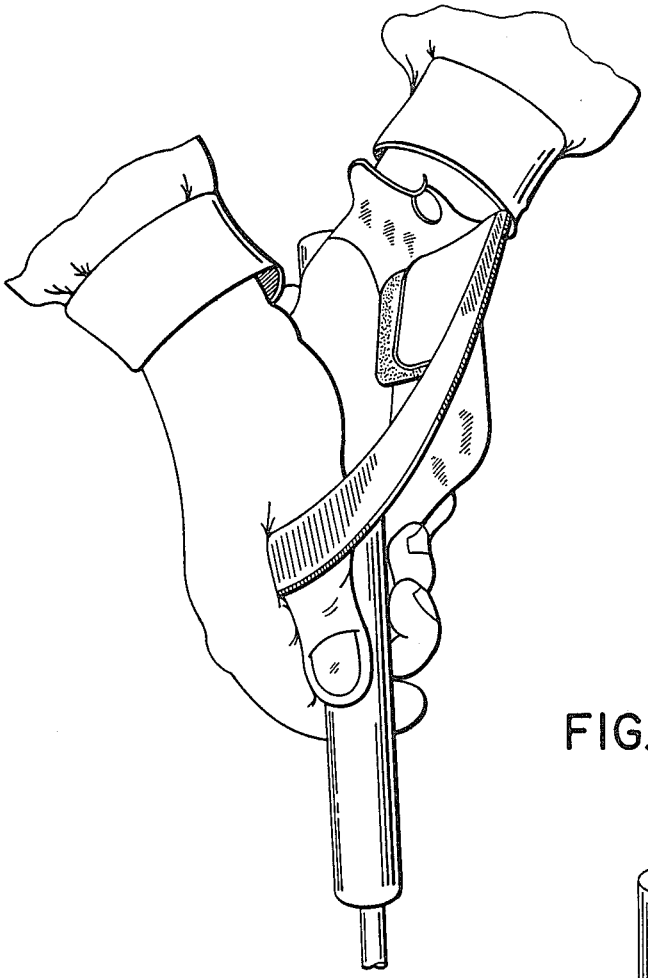
FIG. 3 shows a top view of the golf glove in use holding a golf club.
Figure 4:
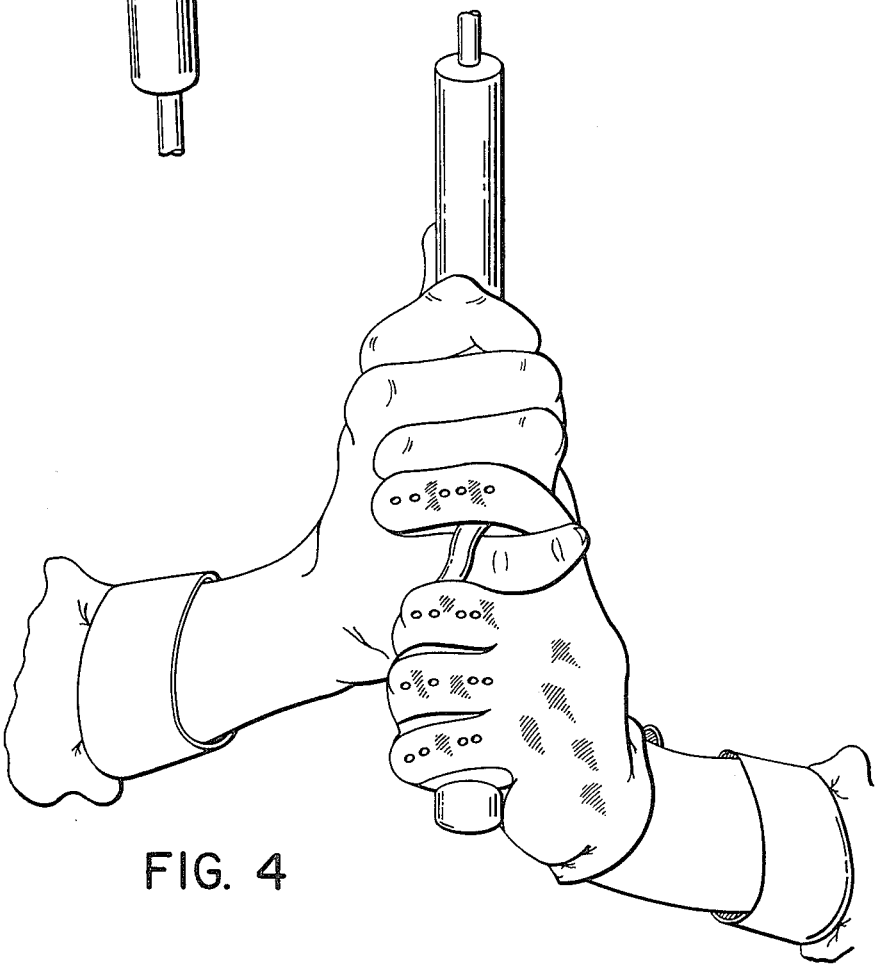
FIG. 4 shows a bottom view of the golf glove in use holding a golf club utilizing the interlocking grip variation.

In operation one adjusts the thumb binding means 20 with the adjustment means 24 to suit his grip. The user places the thumb of the opposing power hand thru the loop which forms the thumb binding means 20 as shown in FIG. 3 and grasps the golf club handle in the usual manner. The thumb binding means 20 is adjusted so as to exert pressure on the inner surface of the thumb of the opposing hand. The fourth finger of the power hand is then placed between the first finger 18 of the gloved hand and the second finger 16 of the gloved hand under the loop formed by the second binding means 26. Thus forming an interlocking grip. FIG. 4 shows the binding means for the fourth finger of the opposing hand for use with the interlocking grip variation 26 securing the fourth finger of the opposing power hand to the gloved hand wherein the point of attachment to the second finger binding of the fourth finger binding for use with the interlocking grip variation 30 is illustrated.

Figure 5:
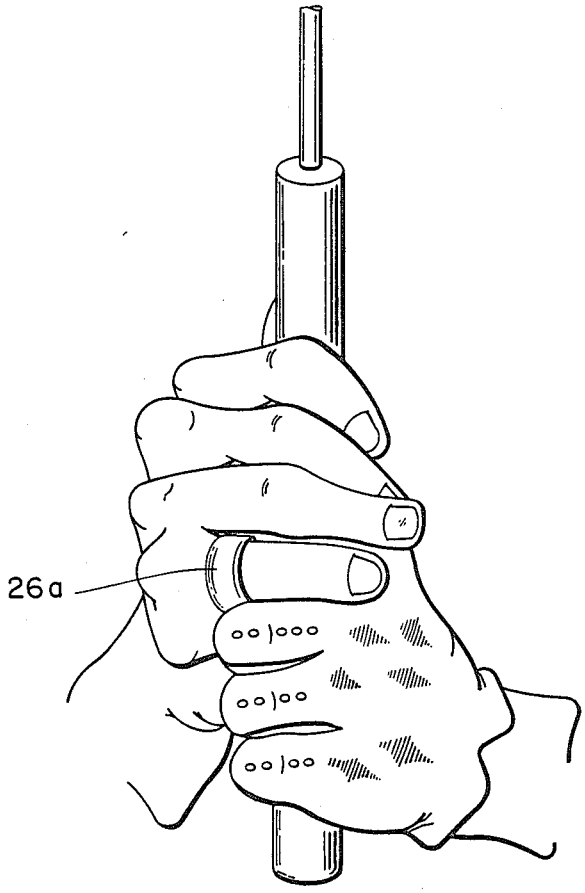
FIG. 5 shows a bottom view of the golf glove in use holding a golf club utilizing the overlapping grip variation.

FIG. 5 shows the use of the binding means for fourth finger of the opposing hand for use with the overlapping grip variation 26*a* where the point of attachment to the second finger of the glove of the fourth finger binding means for use with the overlapping grip variation 32 is shown to accommodate this grip variation. Here too the fourth finger of the power hand is placed between the first finger 18 of the glove hand and the second finger 16 of the gloved hand under the loop formed by the second binding means 26*a* thus forming an overlapping grip.

Users will find the golf gloves illustrated in FIGS. 1 thru 5 advantageous as the gloves enable both the accuracy hand and the power hand to work effectively as one unit. User will notice that the thumb binding means 20 not only holds the thumb securely in position, but also exerts pressure on the inner surface of the thumb, thus causing the wrists to release in unison during the swing. Users will also find that the golf gloves will permit an improved grip on the golf club and more consistent placement of hands on the golf club handle resulting in an improved swing.

While the above description contains many specifications, the reader should not construe these as limitations on the scope of the invention, but merely as exemplifications of preferred embodiments thereof. Those skilled in the art will envision many other possible variations are within its scope. They will be able to make the glove 14 of alternative materials, such as nylon or other cloth used for making golf gloves. They can make many variations of the adjustment means for thumb binding means 24. They can make a binding means consisting of a single band attached to the glove 14 at the wrist closure tab of the glove 22 and to the palmar surface of the glove 14 at the base of the first finger of the glove 18. The aforementioned alternative binding means being less desirable. Accordingly, the reader is requested to determine the scope of the invention by the appended claims and their legal equivalents, and not by the examples which have been given.

I claim:

1. An improved golf glove which binds the golfer's hands together in order that the gloved accuracy hand and the opposing power hand work as one unit, comprising:

a binding means forming a loop attached to the dorsal portion of the glove at the wrist band being approximately two centimeters in width and of substantially sufficient size to permit the thumb of the opposing power hand to pass thru said loop while gripping the golf club, said binding means being attached at an angle of approximately forty-five degrees from the middle finger of the glove with said angle being toward the thumb of said glove so as to hold the base of the thumb of the opposing power hand securely in place during the golf swing while also exerting pressure on the inner surface of the thumb of the opposing power hand forcing the wrist of the opposing power hand to roll in unison with the wrist of the gloved accuracy hand during the golf swing, said binding means being substantially adjustable by way of an adjustment means, said adjustment means allowing for enlargement or diminution of the size of said loop so as to permit varying thumb positions to be utilized while gripping the handle of the golf club, and a second binding means being approximately one centimeter in width forming a loop attached approximately midway between the dorsal inner surface of the first finger of the glove and the adjacent palmar inner surface of the second finger of said glove for use by golfers who use the interlocking grip method, being of substantially sufficient size to permit the fourth finger of the opposing power hand to pass thru said second binding means and be secured to the gloved accuracy hand while permitting varying positions of the fourth finger of the opposing power hand, whereby a golfer can grip and swing the golf club with more consistency.

2. The improved golf glove of claim 1 wherein said adjustable binding means is adjustable by means of a metal buckle.

3. The improved golf glove of claim 1 wherein said adjustable binding means is adjustable by means of a nylon fastner.

4. An improved golf glove which binds the golfer's hands together in order that the gloved accuracy hand and the opposing power hand work as one unit, comprising:

a binding means forming a loop attached to the dorsal portion of the glove at the wrist band being approximately two centimeters in width and of substantially sufficient size to permit the thumb of the opposing power hand to pass thru said loop while gripping the golf club, said binding means being attached at an angle of approximately forty-five degrees from the middle finger of the glove with said angle being toward the thumb of said glove so as to hold the base of the thumb of the opposing power hand securely in place during the golf swing while also exerting pressure on the inner surface of the thumb of the opposing power hand forcing the wrist of the opposing power hand to roll in unison with the wrist of the gloved accuracy hand during the golf swing, said binding means being substantially adjustable by way of an adjustment means, said adjustment means allowing for enlargement or diminution of the size of said loop so as to permit varying thumb positions to be utilized while gripping the handle of the golf club, and a second binding means being approximately one centimeter in width forming a loop attached approximately midway between the dorsal inner surface of the first finger of the glove and the adjacent dorsal inner surface of the second finger of said glove for use by golfers who use the overlapping grip method, being of substantially sufficient size to permit the fourth finger of the opposing power hand to pass thru said second binding means and be secured to the gloved accuracy hand while permitting varying positions of the fourth finger of the opposing power hand, whereby a golfer can grip and swing the golf club with more consistency.

5. The improved golf glove of claim 4 wherein said adjustable binding means is adjustable by means of a metal buckle.

6. The improved golf glove of claim 4 wherein said adjustable binding means is adjustable by means of a nylon fastener.

* * * * *